United States Patent [19]

Nijman

[11] 4,182,029

[45] Jan. 8, 1980

[54] CONDUCTOR TERMINATING APPARATUS

[75] Inventor: John P. Nijman, West Hill, Canada

[73] Assignee: Bunker Ramo Corporation, Oak Brook, Ill.

[21] Appl. No.: 901,947

[22] Filed: May 1, 1978

Related U.S. Application Data

[63] Continuation-in-part of Ser. No. 831,470, Aug. 8, 1977, which is a continuation-in-part of Ser. No. 772,222, Feb. 25, 1977, abandoned.

[51] Int. Cl.[2] ..... H01R 43/04

[52] U.S. Cl. ..... 29/749; 29/751

[58] Field of Search ..... 29/749, 751, 753, 759, 29/760, 566.3, 566.4

[56] References Cited

U.S. PATENT DOCUMENTS

| | | | |
|---|---|---|---|
| 4,035,897 | 7/1977 | Over et al. | 29/749 X |
| 4,047,294 | 9/1977 | Quigley | 29/749 |
| 4,048,710 | 9/1977 | Nijman | 29/566.4 |

*Primary Examiner*—Carl E. Hall

*Attorney, Agent, or Firm*—William Lohff; F. M. Arbuckle

[57] ABSTRACT

An apparatus is disclosed for simultaneously terminating a plurality of insulated metallic conductors in the insulation-piercing contact members of a multi-contact connector. The apparatus includes a base which supports the connector in conductor-receiving position and a carriage which carries a reciprocating insertion tool. The carriage is pivotally attached to the base and moves between an open position and an operating position wherein the insertion tool is aligned with the connector. Locating means are mounted on the carriage in fixed spatial relation to the insertion tool to align the connector for the termination operation as the carriage moves to the operating position. Self-actuated latch means retains the carriage in the operating position and includes a release means which may be actuated while returning the carriage to the open position, all in a single operation.

18 Claims, 8 Drawing Figures

FIG. 7
FIG. 4
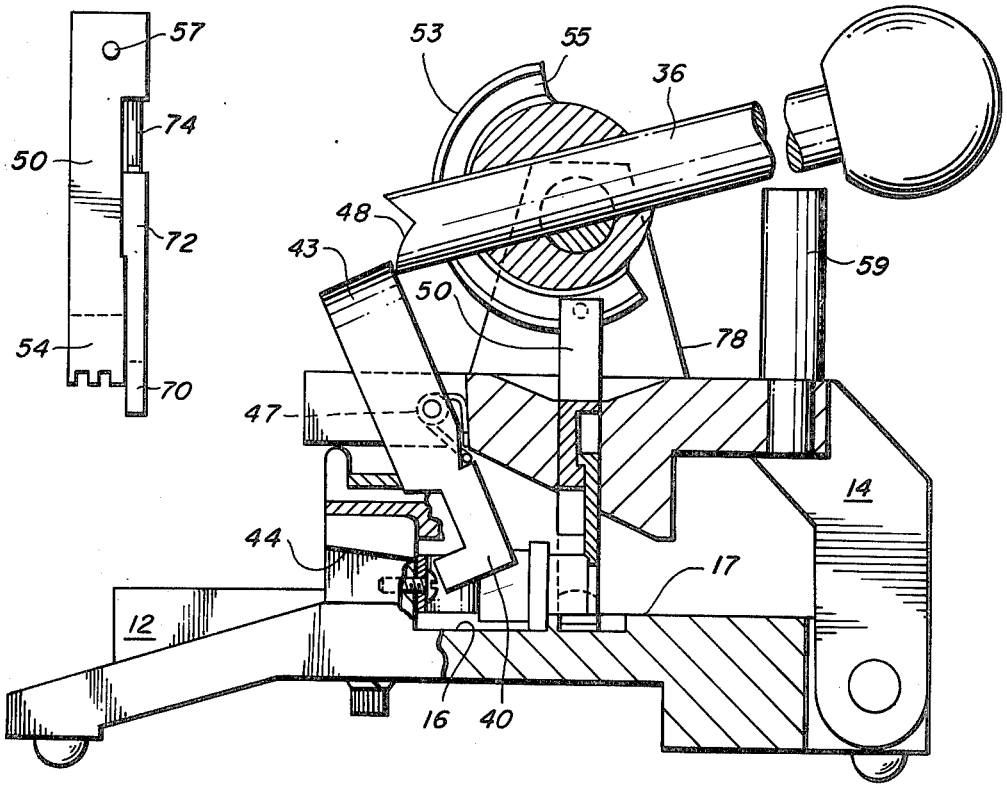
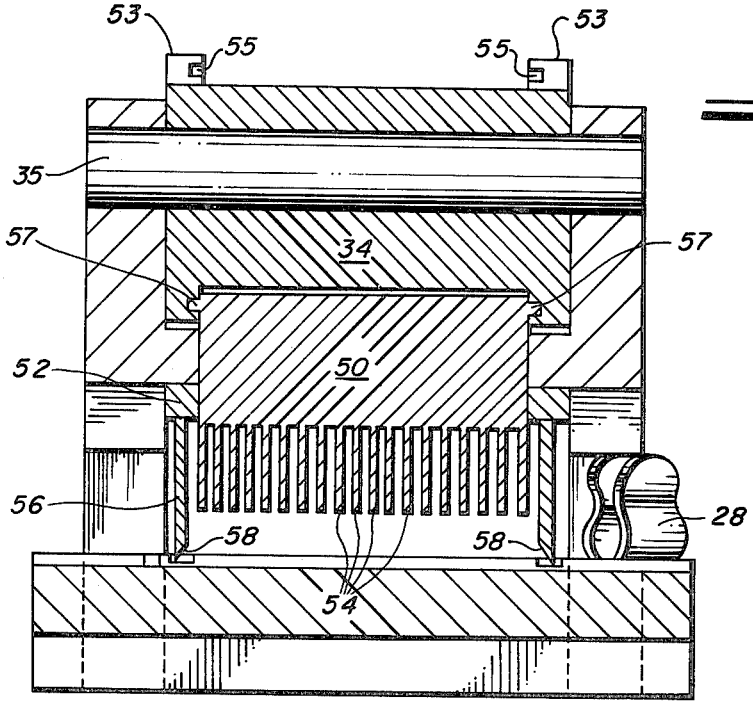
FIG. 5

CONDUCTOR TERMINATING APPARATUS

RELATED INVENTIONS

This is a continuation-in-part of application Ser. No. 831,470, filed Aug. 8, 1977, which is a continuation-in-part of application Ser. No. 772,222 filed Feb. 25, 1977, now abandoned.

BACKGROUND OF THE INVENTION

The present invention relates to apparatus for use in terminating conductors and electrical connectors and, more particularly, to a device which facilitates the in-the-field connection of insulated conductors with multiple contact electrical connectors.

With the advent of miniaturized electronics and electrical components, connectors used in the electrical, communication and data handling industries have been reduced in size, making it more difficult to connect the small, insulated conductors with the appropriate contact terminals of the connector. Accordingly, a wide variety of tools and mechanical devices have been developed in recent years directed at simplifying and expediting the assembly or mounting of conductors in these small electrical connectors. The tools illustrated in U.S. Pat. Nos. 3,758,935; 3,816,897; 3,845,535; 3,866,297; 3,965,558 and 3,972,101 are typical examples of the kinds of apparatus developed to meet this need.

While these prior art devices have met with some success, there are several disadvantages associated with their manufacture and use which have limited their acceptance in the industry. Most of the prior art devices are relatively complex apparatus that result in increased manufacturing costs and, in some instances, a higher incidence of field failure. In addition, while the prior art devices have simplified the conductor termination operations to some extent, the steps required in the use of these devices are time consuming and still not entirely satisfactory. For example, many prior art apparatus require separate operations to align the insertion tool with the connector, latch the insertion tool in position and effect the termination. Moreover, while a few of the prior art tools are portable, they are, in most instances, relatively cumbersome, bulky and not truly convenient for use by field technicians.

Finally, so far as applicants are aware, prior art devices do not provide connector locating means which remain in fixed position relative to the insertion blades of the tool. The structure employed in prior art tools to locate the connector are typically mounted to the connector-holding base of the tool, while the insertion tools in these devices are carried on a movable carriage. This arrangement can possibly lead to improper termination if the carriage or other moving parts of the apparatus become worn or misaligned.

SUMMARY OF THE INVENTION

Accordingly, the present invention is directed to an improved terminating apparatus which overcomes the problems associated with the prior art devices. The termination apparatus of the present invention is small, light, and truly portable and is designed to greatly facilitate and expedite the in-the-field termination of insulated conductors. Moreover, connector locating means are provided which insure proper alignment of the connector contacts with both the conductors being terminated and the insertion blades effecting the termination.

The terminating apparatus of the present invention includes, generally, a base for supporting the connector in conductor-receiving position, a carriage pivotally mounted to the base and which carries a cam operated insertion tool, connector locating means mounted in fixed position relative to the insertion tool and a self-actuating latch mechanism designed to retain the carriage in the operating position and to release the carriage only after the insertion tool has been fully retracted from the connector being terminated. Because of the specific arrangement of the structural components of the tool, most of the termination operations may be expeditiously completed while still assuring a high degree of termination quality, even when the tool is used by unskilled technicians.

In accordance with the preferred embodiment of the present invention, an apparatus is provided for simultaneously terminating a plurality of insulated conductors in the contact members of a multi-contact electrical connector, the apparatus comprising a base, a carriage pivotally attached to the base and carrying an insertion tool thereon, a rotatable cam means for moving the insertion tool into conductor-terminating engagement with the connector, a locating means to properly position the connector and a self-actuating latch means for automatically retaining and releasing the carriage in and from the operating position. The latch means includes a mechanism which cooperates with the cam means to allow locking and unlocking of the carriage for movement to and from the operating position only when the insertion tool is fully retracted. The locating means includes initial locating means on the base providing approximate location of the connector and final locating means mounted on the carriage and providing precise location of the connector.

BRIEF DESCRIPTION OF THE DRAWINGS

The novel features which are believed to be characteristic of the invention are set forth in the appended claims. The invention itself, however, together with further objects and attendant advantages thereof, will best be understood by reference to the following description taken in connection with the accompanying drawings in which:

FIG. 4 is a view similar to that of FIG. 3, in partial cross-section, showing the insertion tool disengaged from the connector;

FIG. 5 is a cross-sectional view taken along line 5—5 of FIG. 3 with the connector removed and illustrating, in greater detail, the insertion tool and a preferred connector locating means;

FIG. 7 is a side elevation of a preferred insertion tool of the present invention.

DETAILED DESCRIPTION OF THE PREFERRED EMBODIMENTS

Figure 1:
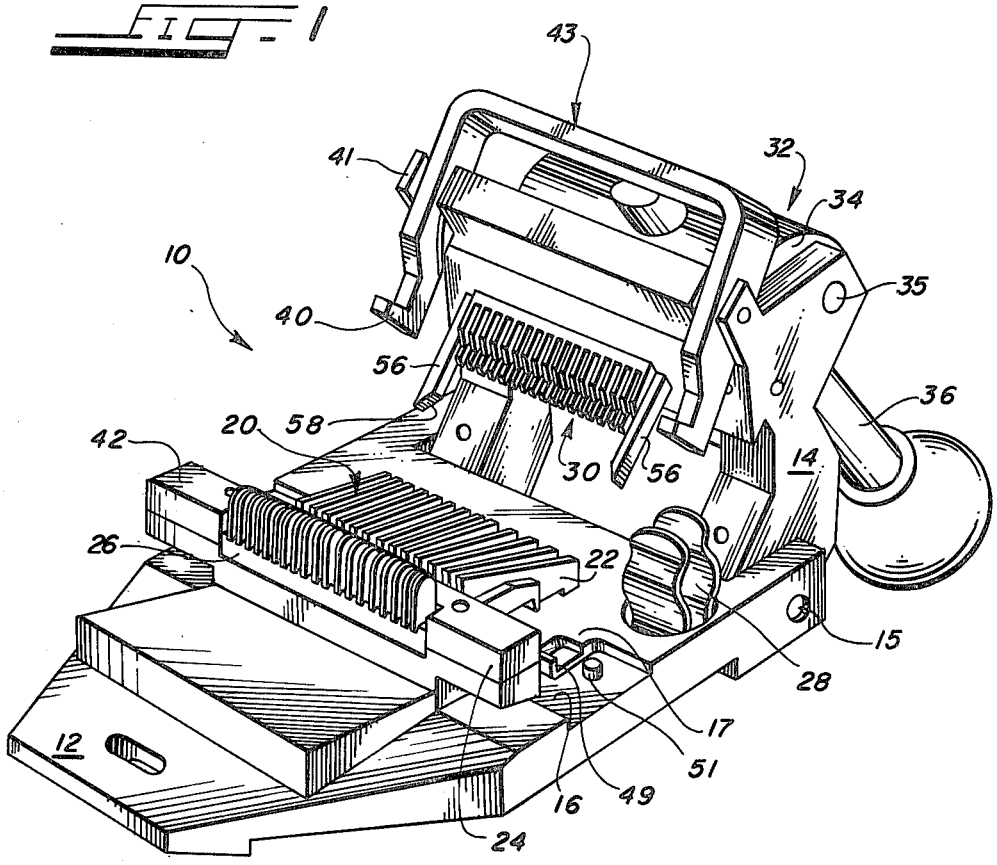
FIG. 1 is a perspective view illustrating a preferred embodiment of the invention with the carriage thereof in at least a partially open position.
Figure 2:
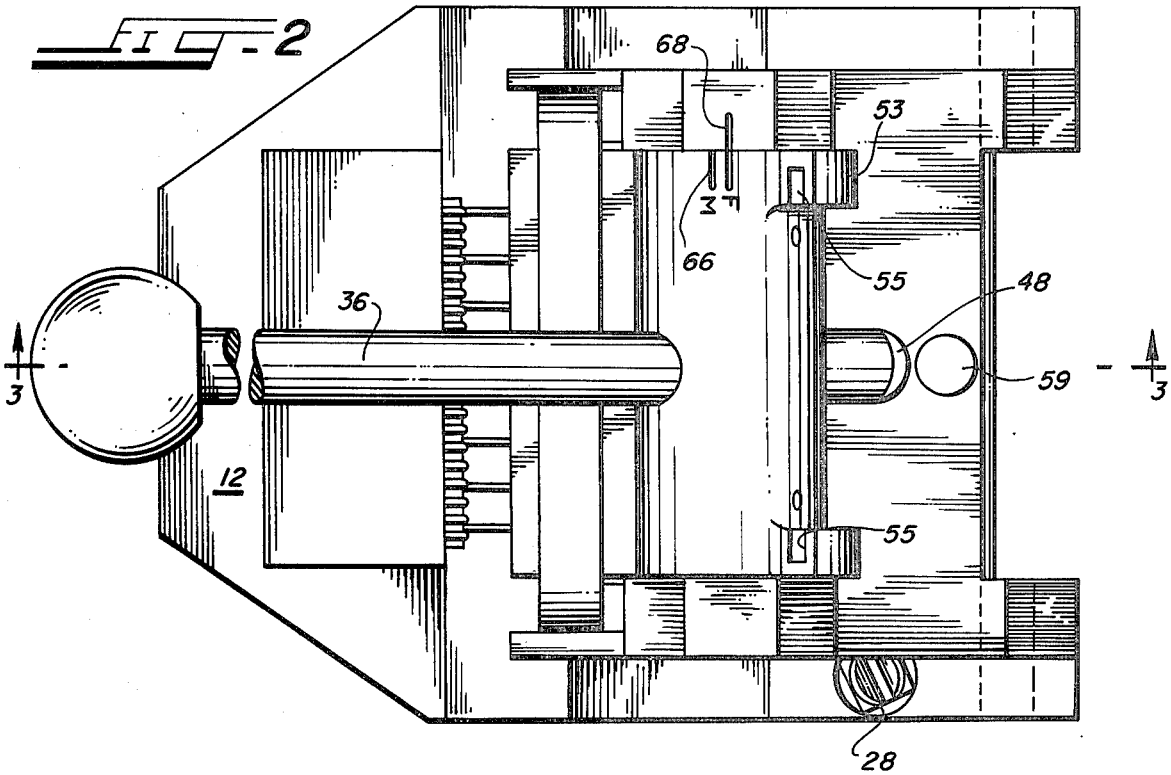
FIG. 2 is a plan view of the embodiment illustrated in FIG. 1.

Referring now to the drawings, and particularly to FIGS. 1 and 2, a conductor terminating apparatus, designated generally as 10, is illustrated, having a base 12 and a carriage 14 pivotally attached to the base. The base 12 includes connector supporting means comprising surfaces 16 and 17. A conductor aligning jig or comb element 20 is also provided through which the individual insulated conductors are dressed and thereby positioned in termination position adjacent the contacts of the connector. The illustrated jig 20 comprises a plurality of individual comb teeth 22 which are removably secured in spaced relation between plates 24 and 26, respectively. Other conductor jig structures may be employed and are well known to those skilled in the art. A spring clamp 28 is disposed on one side of the base 12 to accommodate a bundle of conductors or a multi-conductor cable.

Figure 3:
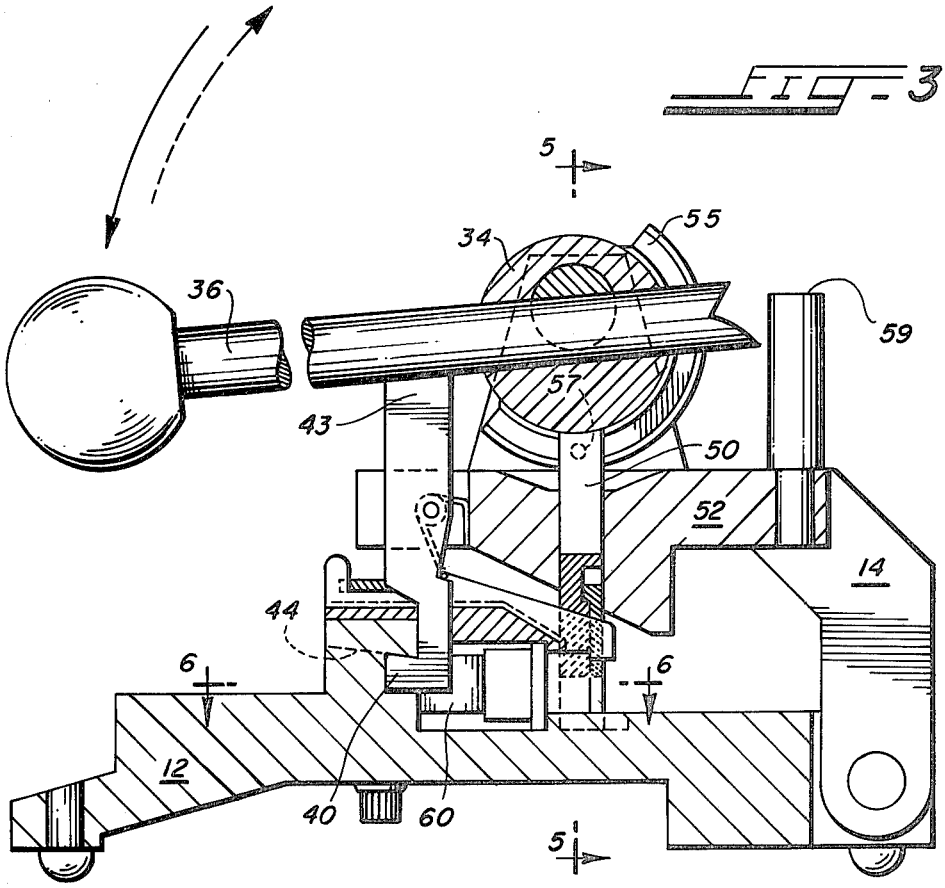
FIG. 3 is a side view in partial cross-section taken along line 3—3 of FIG. 2 and showing the insertion tool in conductor-terminating engagement with a connector.

The carriage 14 is pivotally attached to the rear portion of base 12 by hinges 15 and is movable between an open position remote from the connector, as illustrated in FIG. 1, wherein the individual conductors may be conveniently dressed through the jig 20, and a closed operating position adjacent the connector, as illustrated in FIGS. 3 and 4, in which a terminating means is brought into alignment with the connector and conductor jig 20 for the termination operation. The terminating means includes an insertion tool 30 mounted for reciprocal movement in carriage 14 and a rotatable cam means 32, having a cam cylinder 34 eccentrically mounted on shaft 35 and a cam lever 36. As can be clearly seen in FIGS. 3–5, the insertion tool 30 comprises a stem 50 adapted for reciprocal movement within the upper plate 52 of carriage 14 and a series of spaced insertion blades 54. Cam cylinder 34 includes flanges 53 having inwardly facing annular cam recesses 55 which cooperate with the cam following pins 57 at each end of stem 50 to extend and retract the insertion tool 30 as the cam means 32 is rotated by lever 36. A stop 56 is positioned on carriage 14 to prevent excessive rotation of the cam means 32 and the possible withdrawal of stem 50 from plate 52.

In accordance with the present invention, the termination tool 10 is provided with a self-actuating latch mechanism which comprises at least one detent 40 pivotally mounted to the distal end 41 of the carriage 14 and a latch surface 44. As is clearly illustrated in FIGS. 1 and 2 and in accordance with a preferred embodiment of the invention, the latch mechanism includes a pair of detents 40 each of which is pivotally mounted to the free end 41 of carriage 14 and urged toward a locking position by torsion springs 47 or other suitable biasing means. The detents include release means such as transverse handle 43 which joins the two detents 40 thereby forming an integral latch mechanism. Handle 43 is positioned to engage the end 48 of lever 36 such that the detents will be displaced only when lever 36 is fully rotated to the rear of the apparatus as illustrated in FIG. 4. Rotational displacement of the detents 40 allows them to clear the flanges 42, thereby permitting final placement of carriage 14 in the closed operating position. Once the carriage is in the operating position, the lever 36 may be rotated toward the front of the apparatus, thereby releasing handle 43 and locking the carriage in place.

It will be appreciated that the illustrated construction and arrangement of the latch mechanism and cam means, while preferred, may be modified in ways apparent to those skilled in the art without loss of the advantages of the present invention. Thus, it is only necessary that the release means for the latch mechanism be positioned relative to the cam means 32 such that the latch mechanism is actuated as the lever 36 is rotated.

The termination tool 10 also includes improved initial and final locating means to precisely align the connector, both longitudinally and transversely, with respect to the jig 20 and the insertion tool 30.

Figure 6:
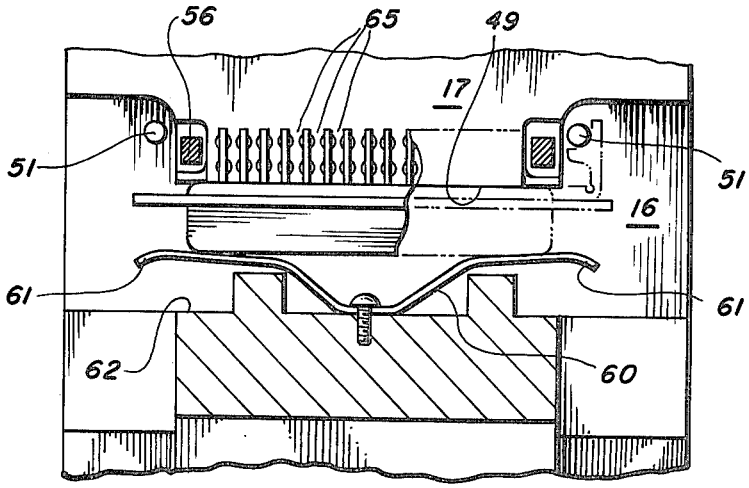
FIG. 6 is a partial view, in corss-section, taken along line 6—6 of FIG. 3 and illustrating more clearly the connector supporting and locating structure of the present invention.

The initial or preliminary locating means is provided on base 12 and comprises a connector locating shoulder 49 and studs 51 which abut external surfaces on the connector to locate the connector longitudinally. As can be best seen in FIG. 6, a leaf spring 60 is mounted on wall 62 opposite the connector locating shoulder 49. Leaf spring 60 includes outwardly flaring extremities 61 which bias the connector against shoulder 49, thereby properly locating the connector transversely with respect to both the conductor jig 20 and insertion tool 30 and properly orientating the contact members 65 for acceptance of the insulated conductors. Thus, shoulder 49 provides an initial alignment of the connector to facilitate the precise, final alignment effected by the final locating means.

The final locating means is mounted on the carriage 14 and comprises a pair of pins 56 which depend from collar 52 and terminate at extremities which are below the lowermost travel of the insertion blades 54. The extremities of pins 56 are formed as camming surfaces 58. As the carriage 14 is rotated to the operating position, the surfaces 58 engage the opposite ends of the connector to insure its proper longitudinal alignment with the insertion tool 30. Since the pins 56 are mounted to the carriage 14, they are disengaged from the connector as the carriage is retracted from the operating position, and the operator is not required to disengage them in a separate operation.

Suitable conductor retaining means are also provided in order to hold the individual conductors within the slots defined by comb teeth 22 after the conductors have been dressed through the jig 20. One such retaining means comprises a series of dimples (not shown) formed in the comb teeth 22, each dimple acting with an adjacent comb tooth to restrain movement of the conductors. Another known retaining means comprises a closed-helix coil spring mounted to the jig 20. Of course, other suitable retaining means will be readily apparent to those skilled in the art.

In order to insure that the proper termination force is applied when terminating conductors in either male or female connectors, the cam cylinder 34 includes termination indicia comprising score lines 66 which align with a score line 68 on the carriage 14 when the appropriate degree of rotation of cylinder 34 has been effected.

A preferred insertion tool is illustrated in FIG. 7 which includes a two-piece insertion blade design. The stem 50 includes terminating blades 54 which function in the conventional manner and stuffer blades 70 which extend from the end of a bar 72 slidably mounted on the stem 50 and downwardly biased by leaf spring 74. The stuffer blades engage the individual conductors prior to their being trimmed by the terminating blades and hold the conductors after the trimming operation to properly position the conductors within the individual contacts of the connector during termination.

In the operation of the present invention a multicontact electrical connector having a two oppositely facing rows of insulation-piercing contact members is inserted into the cavity defined by the conductor jig 20 and surface 16. The outwardly flaring extremities 61 of leaf spring 60 to force the connector into abutment with shoulder 49 with the portion of the connector carrying the insulation-piercing contact members resting on support surface 17. With the carriage 14 in the open position, a cable comprising a bundle of individual insulated conductors is secured in the clamp 28, and the conductors are dressed through the slots defined by the comb teeth 22.

After having dressed the conductors for the desired wiring schedule, the operator grasps handle 36 and the carriage 14 is pivoted to the operating position, shown for example in FIG. 4. At the same time, the locating pins 56 mounted in collar 52 drop over the ends of the connector, thereby properly locating the connector longitudinally with the insertion tool 30. In this manner, the carriage 14 is brought to the operating position with the insertion tool 30 properly aligned adjacent the conductor jig 20 and the connector.

As the carriage 14 reaches the operating position, the operator continues the rotation of cam lever 36 in a single, continuous motion, as depicted by the solid arrow in FIG. 3. This operation first acts to disengage handle 43 from the end 48 of lever 36 to lock the carriage in its operating position and also actuates cam cylinder 34 and drives the insertion blades 54 of insertion tool 30 down into engagement with the insulated conductors and into the respective contact members 65 of the connector. Thus, in the manner well known in the art, the individual conductors are trimmed and terminated in the respective insulation-piercing contacts. The required rotation of cam cylinder 34 is indicated by the termination indicia, as is shown in FIG. 2. The operator then reverses the rotation of cam lever 36, as depicted by the dashed-line arrow in FIG. 3, and when lever 36 reaches the position illustrated in FIG. 4, the carriage 14 is automatically unlocked as the latch mechanism is disengaged by the end 48 of lever 36. Further rotation of the cam cylinder 34 is prevented by stop means 59 which transmits the forces applied to the lever 36 to the carriage 14, thereby allowing the carriage to pivot about hinges 15 to the open position, all in a single motion of the lever 36. The stop 59 also assures that lever 36 is not rotated to such an extent that the pins 57 disengage from cam recesses 55. The cable is then removed from the clamp 28 and the connector may be disengaged from the conductor jig 20.

In order to terminate the remaining conductors in the oppositely facing row of contact members, the connector is inverted and reinserted into the cavity below the conductor jig 20, and the operations described above are repeated.

Figure 8:
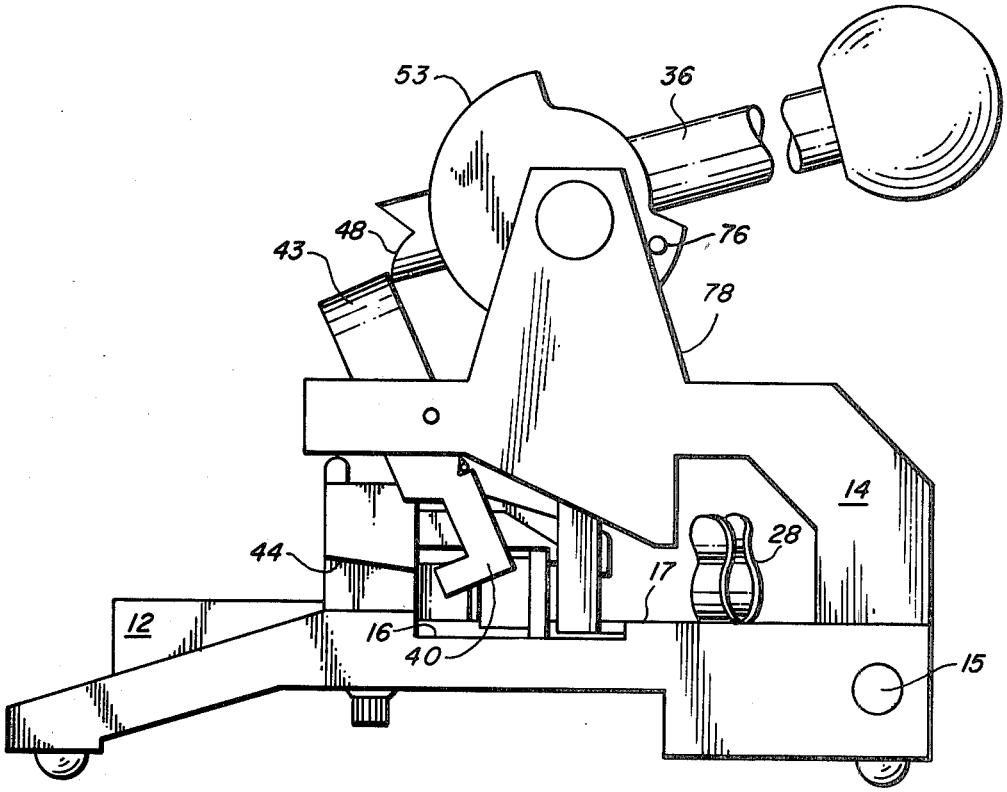
FIG. 8 is a view in partial cross-section similar to that of FIG. 4, showing an alternative stop mechanism.

An alternative stop means is illustrated in FIG. 8 and includes a pair of abutment members such as pins 76 extending laterally outwardly from flanges 53. The pins 76 are located on the flanges 53 such that once the lever 36 has been rotated sufficiently to disengage the latch mechanism, the pins abut against surface 78 of carriage 14. As in the case with stop 59 (illustrated in FIG. 4), the pins 76 transmit the forces applied to lever 36 to the carriage 14, thereby pivoting the carriage to the open position.

It will be appreciated from the foregoing description that the present invention provides not only a small and truly portable termination tool, but also one which is reliable and very easy to use. In addition to the improved locating means and the self-actuating latch mechanism, the present invention also provides a carriage which pivots easily out of the way for expedited wiring and still employs a reciprocating insertion tool whose path of travel, relative to the connector, is linear rather than arcuate. Moreover, the structural relationship and interaction of the cam operated insertion tool, latch mechanism and stop means results in a "single-action" operation which is easily performed with only one hand. That is, a single forward rotation of lever 36 acts to close and lock the carriage, positively locate the connector and extend the insertion tool to terminate the conductors; and a single rearward rotation of the lever retracts the insertion tool and unlocks and opens the carriage. The apparatus is, therefore, extremely easy to use and speeds the termination operation.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. Apparatus for simultaneously terminating a plurality of insulated conductors in the contact members of an electrical connector, comprising:

a base including means for supporting the connector in conductor-receiving position;

a carriage pivotally attached to said base and movable between an open position wherein said carriage is remote from said connector and an operating position wherein said carriage is adjacent said connector;

an insertion tool mounted for reciprocal movement in said carriage and including means for engaging and pressing said conductors into respective contact members of the connector when said carriage is in said operating position to thereby terminate said conductors in said respective contact members;

rotatable cam means mounted on said carriage for moving said insertion tool into and out of conductor-terminating engagement with said connector, said cam means including cam actuating means for rotating said cam means; and latch means for retaining said carriage in said operating position and including means coacting with said cam actuating means for automatically locking and unlocking said latch means.

2. Apparatus for simultaneously terminating a plurality of insulated conductors in the contact members of an electrical connector, comprising:

a base including means for supporting the connector in conductor-receiving position;

a carriage pivotally attached to said base and movable between an open position wherein said carriage is remote from said connector and an operating position wherein said carriage is adjacent said connector;

an insertion tool mounted for reciprocal movement in said carriage and including means for engaging and pressing said conductors into respective contact members of the connector when said carriage is in said operating position to thereby terminate said conductors in said respective contact members;

rotatable cam means mounted on said carriage for moving said insertion tool into and out of conductor-terminating engagement with said connector, said cam means including cam actuating means for rotating said cam means; and latch means for retaining said carriage in said operating position and including means contacting with said cam actuating means for automatically locking and unlocking said latch means, said latch means comprising a spring biased detent pivotally mounted to said carriage, said detent being provided for engaging a latch surface on said base only with said insertion tool fully retracted.

3. The termination apparatus of claim 2 wherein said latch means comprises a pair of said detents and a transverse member joining said pair of detents.

4. The termination apparatus of claim 1 wherein said cam means comprises a cam cylinder eccentrically mounted to said carriage and said cam actuating means comprises an elongated lever.

5. The termination apparatus of claim 4 wherein said cam cylinder includes at least one circumferential collar having an annular recess which cooperates with a pin member of said insertion tool to effect said reciprocal movement of said insertion member as said cam means is rotated.

6. The termination apparatus of claim 1 further including means for indicating that said insertion tool is in conductor-terminating engagement with said connector.

7. The termination apparatus of claim 6 wherein said indicating means comprises score lines on said cam means and said carriage positioned to align when said insertion tool is in said conductor-terminating position.

8. The termination apparatus of claim 1 further including means for aligning each said conductor in terminating position adjacent one of the connector contact members.

9. The termination apparatus of claim 8 wherein said conductor aligning means includes means for retaining said conductors in said terminating position.

10. The terminating apparatus of claim 1 further including connector locating means for aligning the connector longitudinally with respect to the insertion tool, said locating means mounted on and movable with said carriage is fixed position relative to said insertion tool.

11. The termination apparatus of claim 10 wherein said locating means comprises a pair of pins depending from said carriage.

12. The termination apparatus of claim 11 wherein said pins each include a cam surface extermity.

13. The termination apparatus of claim 11 wherein said pins each terminate at a level below the lowermost point of travel of said termination tool.

14. An apparatus for simultaneously terminating a plurality of insulated conductors in a multi-contact electrical connector, said connector having at least one row of insulation-piercing contact members arranged therein, said apparatus comprising:

a base including means for supporting the connector in conductor-receiving position;

a carriage pivotally attached to the base and movable between an open position remote from the connector and an operating position adjacent the connector;

means mounted on said carriage for terminating the conductors in respective contact members of the connector and including means to actuate said terminating means; and self-actuating latch means for retaining said carriage in said operating position and including means coacting with said actuating means for automatically locking and unlocking said latch means.

15. An apparatus for simultaneously terminating a plurality of insulated conductors in a multi-contact electrical connector, said connector having two oppositely facing rows of insulation piercing contact members arranged therein, said apparatus comprising:

a base including means for supporting the connector in conductor receiving position with one of said rows of contact members facing upwardly from said base;

a carriage pivotally attached to said base and movable between an open position remote from the connector and an operating position wherein said carriage is adjacent said connector;

an insertion tool mounted for reciprocal movement in said carriage and including means for engaging and pressing said conductors in respective upwardly facing contact members to thereby terminate said conductors;

means for locating the connector in conductor receiving position including initial locating means associated with said base to place the connector in approximate conductor receiving position and final locating means associated with said carriage to place the connector in precise conductor receiving position; and latch means for retaining said carriage in said operating position during the termination operation.

16. The terminating apparatus of claim 15 wherein said initial locating means includes abutting surfaces on said base configured to receive and align with external surfaces of the connector.

17. The terminating apparatus of claim 15 wherein said final locating means includes a pair of pins depending from said carriage and positioned to abut opposite ends of the connector.

18. The terminating apparatus of claim 17 wherein said pins have cam surface extremities which terminate below the lowermost point of travel of said insertion tool.

* * * * *